United States Patent [19]

Bereskin

[11] 4,172,483

[45] Oct. 30, 1979

[54] PERCUSSION HEAD TOOL

[76] Inventor: Alexander B. Bereskin, 452 Riddle Rd., Cincinnati, Ohio 45220

[21] Appl. No.: 936,382

[22] Filed: Aug. 24, 1978

[51] Int. Cl.[2] ..... B25C 1/00; B25D 1/00

[52] U.S. Cl. ..... 145/29 R; 145/29 B

[58] Field of Search ..... 145/29 B, 29 R, 78

[56] References Cited

U.S. PATENT DOCUMENTS

| | | | |
|---|---|---|---|
| 1,435,851 | 11/1922 | Isham | 145/29 B |
| 2,678,853 | 5/1954 | Reeder | 145/29 B |
| 2,980,154 | 4/1961 | Williamson | 145/29 R |

FOREIGN PATENT DOCUMENTS

| | | | |
|---|---|---|---|
| 846702 | 8/1960 | United Kingdom | 145/29 R |

*Primary Examiner*—Robert Louis Spruill
*Assistant Examiner*—J. T. Zatarga
*Attorney, Agent, or Firm*—Wood, Herron & Evans

[57] ABSTRACT

A protective sleeve for protecting the handle of a percussion head tool such as a sledge hammer, axe or the like. A protective oversized rigid sleeve, e.g., of a metal, is positioned around the tool handle in a location adjacent to that head. The annular cavity defined between the oversized rigid sleeve and the handle is filled with a resilient energy absorbing material, e.g., with a rubber.

1 Claim, 1 Drawing Figure

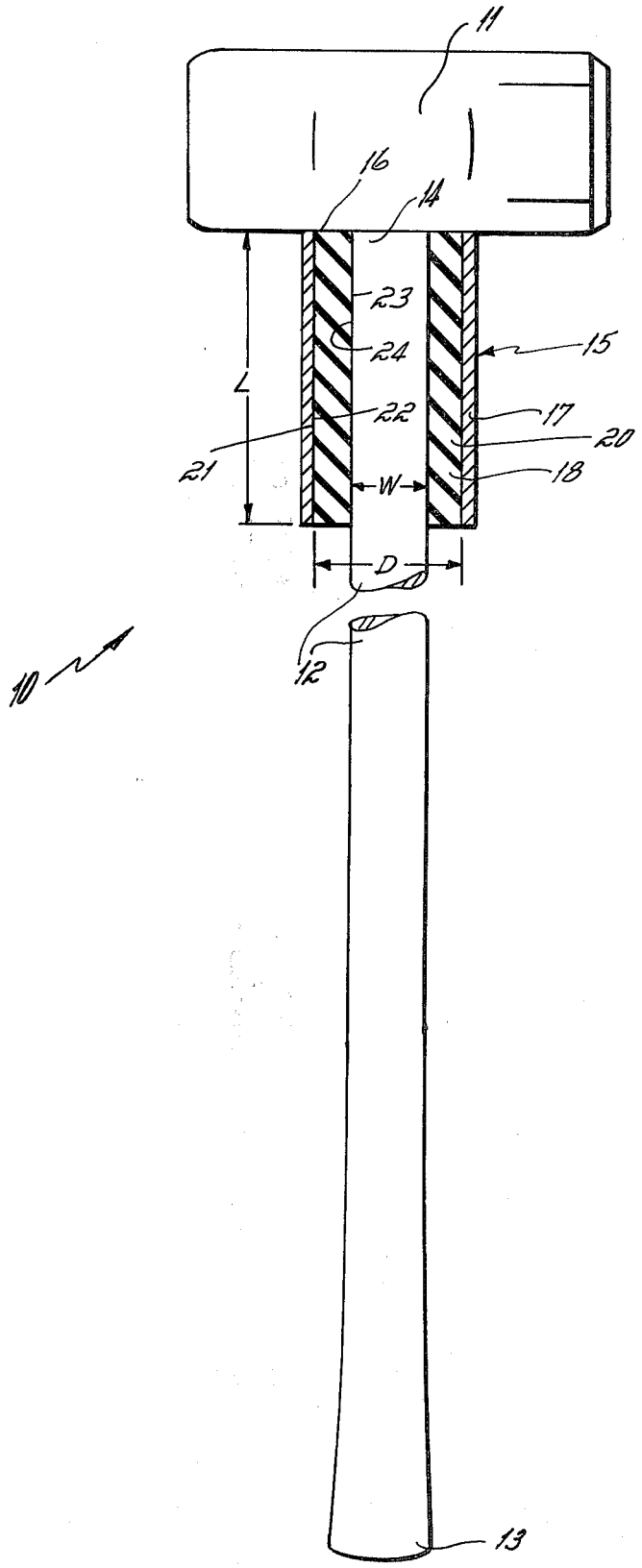
11
16
14
23
24
15
L
22
17
20
21
W
18
D
12
10
13

PERCUSSION HEAD TOOL

This invention relates to percussion head tools.

Percussion head tools are, of course, very well known to the prior art. Percussion head tools include such manual implements as sledge hammers, axes, and the like. In the case of a sledge hammer, for example, and when that sledge is being used to split logs with a wedge, it is not an uncommon experience for the user to miss the wedge with the sledge hammer's head and, inadvertently and unintentionally to strike the wedge with that handle portion closely adjacent to the sledge's percussion head. Repeated strikings of a sledge's handle in the area adjacent the sledge's head will result in significant weakening of the handle in that area, and, indeed, may well cause the handle to break in that area. This requires that a new handle be installed with the sledge's head which is, of course, troublesome and time consuming.

It is known to the prior art to provide protective devices for the handles of percussion head tools such as axes, sledge hammers, and the like. Typically, such protective devices include a sleeve like structure receivable in assembled relation with the implement's handle in an area adjacent the implement's percussion head. Typical of such protective sleeves is that illustrated in U.S. Pat. No. 1,206,695.

It has been the primary objective of this invention to provide an improved protective device for a percussion head tool, that device being installed on the tool's handle in an area immediately adjacent the tool's percussion head for protecting the handle of the tool, i.e., for preventing breakage of the handle, in that handle area adjacent the tool's percussion head. In accord with this objective, the improved percussion head tool of this invention includes a protective oversized rigid sleeve, e.g., of a metal, is positioned around the tool handle in a location adjacent to that head. The annular cavity defined between the oversized rigid sleeve and the handle is filled with a resilient energy absorbing material, e.g., with a rubber. In use, when swinging the tool's percussion head toward an object, but upon missing the object and instead striking the object with the protective device, the impact forces will be distributed throughout the resilient material and generally dampened by that material prior to reaching the handle area protected by the protective device, thereby protecting the handle against breakage.

Other objectives and advantages of this invention will be more apparent from the following detailed description with the drawings in which:

The FIGURE illustrates a percussion head tool in accord with the principles of this invention, the protective device being illustrated in cross section for purposes of clarity.

A manual percussion head tool 10 in accord with the principles of this invention is shown in the FIGURE in the form of a sledge hammer. It will be understood to those skilled in the art, however, that the percussion head tool may be any tool having a percussion head and a breakable handle, e.g., an axe, or the like.

In the embodiment illustrated in the FIGURE, the sledge hammer 10 is provided with a sledge or percussion head 11 of the usual type, and includes a handle 12 fabricated of wood. As with the usual sledge hammer handle 12, the wood handle is not a true cylinder from its free end 13 to its head end 14 but is, instead, slightly shaped and slightly curved between those ends so as to enhance manual use of it by the user.

A protective sleeve 15 structure in accord with the principles of this invention is installed on the sledge hammer's handle 12 in the immediate vicinity of, i.e., adjacent to, the sledge's head 11. The protective sleeve 15 is butted at one end, as at 16, against the sledge's head 11. The protective sleeve 15 is also sized to extend up the handle 12 toward the free end 13 a length L which is sufficient to insure that the protective device 15 will be hit instead of the wood handle 12, when a user closely misses an object (e.g., a wedge, not shown) upon swinging toward that object.

The protective sleeve 15 is fabricated of a rigid outer sleeve 17, e.g., of cylindrical configuration and of a metal. Note that the inside diameter D of the rigid outer shield is greater than the width W of the wooden handle 12 at any point on that handle embraced by the outer sleeve 17. This dimensional relationship of the rigid outer sleeve 17 relative to that length of the wooden handle 12 protected by the shield creates a cavity 18 of generally toroidal cross section between the outer sleeve 17 and the handle during assembly. This annular cavity 18 is filled by a resilient energy absorbing material, e.g., a rubber or the like, thereby defining a resilient inner sleeve 20. Thus, and as structured, the rigid outer sleeve 17 is retained in spaced relation from the handle 12 by the resilient energy absorbing material in the form of the toroidal inner sleeve 20 defined between that outer sleeve 17 and the handle.

Note that the inner sleeve 20 established by the resilient energy absorbing material is in surface contact throughout its cylindrical outer surface 21 with the cylindrical inner surface 22 of the rigid outer sleeve 17 from one end of the protective sleeve 15 to the other. Further, note particularly that the inner surface 23 of the resilient energy absorbing inner sleeve 20 is in contact throughout its inner surface with the outer surface 24 of the sledge's handle 12 from one end of the protective sleeve 15 to the other. This surface area contact of the resilient energy absorbing inner sleeve 20 with the handle 12 and with the outer sleeve 20 aids in retaining the protective sleeve 17, 20 in its desired operational position on the handle 12 relative to the percussion head 11 as shown in the FIGURE. Further, and when the sledge 10 is swung at an object, e.g., a wedge used for splitting logs, and when that object is missed and the wedge struck with the rigid outer sleeve 17 instead, the resilient energy absorbing sleeve 20 tends to dampen and distribute the point force contact on outer sleeve 17 throughout the energy absorbing material and, also, throughout that surface area of the handle 12 embraced by the inner sleeve 20. This dispersion or dampening of the point force contact on the outer sleeve 20 throughout, first, the energy absorbing inner sleeve 20, and, second, the entire surface area of the handle 12 section in contact with that inner sleeve 20, tends to minimize damage to the tool's handle in that area of the handle protected by the protective sleeve 15 when the object being aimed at with the percussion head, e.g., the wedge, is missed, i.e., when the outer sleeve 17 is struck instead of the object. In addition to protecting the handle against breakage on a miss-hit, the outer sleeve and inner resilient liner also functions to tend to dampen out shock forces imparted to the handle which may otherwise be transmitted along the handle and result in a stinging sensation to the user's hands.

Having described in detail the preferred embodiment of my invention, what I desire to claim and protect by Letters Patent is:

1. An improved percussion head tool comprising a percussion head, and a handle connected to said percussion head in a rigid and non-cushioned fashion, and a protective sleeve mounted on a section of said handle adjacent to said percussion head, said protective sleeve comprising a rigid outer sleeve surrounding said handle and a resilient energy absorbing inner sleeve interposed between said handle and said rigid outer sleeve, said resilient energy absorbing inner sleeve being in surface contact with said handle at the inner surface of said inner sleeve and being in surface contact with said outer sleeve at the outer surface of said inner sleeve, said protective sleeve being unconnected to said head except through mounting on said handle so that the entire outer sleeve can move relative to said head to that extent permitted by said inner sleeve when a force is exerted on said outer sleeve transverse to the longitudinal axis thereof, said outer and inner sleeves cooperating to dampen shock forces introduced to said outer sleeve upon use of said tool, thereby also dampening shock forces introduced through said handle to a user's hand, when an object is struck with said outer sleeve instead of said percussion head upon use of said tool.

* * * * *